US007175973B2

(12) United States Patent
Okano et al.

(10) Patent No.: US 7,175,973 B2
(45) Date of Patent: Feb. 13, 2007

(54) INK JET RECORDING HEAD AND METHOD FOR MANUFACTURING THE SAME

(75) Inventors: Akihiko Okano, Kanagawa (JP); Shoji Shiba, Kanagawa (JP); Hiroe Ishikura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 10/914,218

(22) Filed: Aug. 10, 2004

(65) Prior Publication Data

US 2005/0046662 A1 Mar. 3, 2005

(30) Foreign Application Priority Data

Aug. 29, 2003 (JP) ..... 2003-306419

(51) Int. Cl.
*B41J 2/16* (2006.01)

(52) U.S. Cl. ..... 430/320

(58) Field of Classification Search ..... None
See application file for complete search history.

(56) References Cited

U.S. PATENT DOCUMENTS

| | | | | |
|---|---|---|---|---|
| 4,393,129 A | | 7/1983 | Glashauser et al. | 430/296 |
| 5,290,667 A | * | 3/1994 | Shiba et al. | 430/328 |
| 5,478,606 A | | 12/1995 | Ohkuma et al. | 427/555 |
| 5,524,784 A | | 6/1996 | Shiba et al. | 216/27 |

(Continued)

FOREIGN PATENT DOCUMENTS

JP 3-10089 2/1991

(Continued)

*Primary Examiner*—John A. McPherson
(74) *Attorney, Agent, or Firm*—Fitzpatrick, Cella, Harper & Scinto

(57) ABSTRACT

A method for manufacturing an ink jet recording head comprising: (a) a process of forming a positive resist layer (I) made of a photodegradation positive resist (i) on a surface of a substrate having an energy generation element; (b) a process of removing a predetermined area of the positive resist layer (I) by photolithography to form a micro structure which becomes at least an ink flow path; (c) a process of forming a coating resin layer on the surface of the substrate on which the micro structure has been formed; (d) a process of forming ink discharge ports in a portion where the coating resin layer covers the micro structure by photolithography; and (e) a process of removing the micro structure to form the ink flow path communicated with the ink discharge ports, wherein the photodegradation positive resist (i) includes a polymer having a glutarimide structure shown by the following chemical formula (1) in a molecule;

(1)

wherein $R^1$ designates a hydrogen atom or an alkyl group, an allyl group, or an aralkyl group which has the carbon number ranging from 1 to 20.

7 Claims, 2 Drawing Sheets

U.S. PATENT DOCUMENTS

| | | | | |
|---|---|---|---|---|
| 5,663,752 | A | 9/1997 | Imamura et al. | 347/65 |
| 5,922,401 | A | 7/1999 | Kashiwazaki et al. | 427/164 |
| 6,312,771 | B1 | 11/2001 | Kashiwazaki et al. | 428/1.33 |
| 6,455,112 | B1 | 9/2002 | Ohkuma et al. | 427/504 |
| 6,461,798 | B1 * | 10/2002 | Ohkuma et al. | 430/320 |
| 2003/0011655 | A1 | 1/2003 | Miyagawa et al. | 347/20 |
| 2003/0159288 | A1 * | 8/2003 | Ohkuma et al. | 29/890.1 |

FOREIGN PATENT DOCUMENTS

| | | |
|---|---|---|
| JP | 7-3579 | 1/1995 |
| JP | 3143308 | 12/2000 |

* cited by examiner

INK JET RECORDING HEAD AND METHOD FOR MANUFACTURING THE SAME

BACKGROUND OF THE INVENTION

1. Field of the Invention

The present invention relates to an ink jet recording head, which performs recording by discharging ink to deposit to a recording medium, and a method for manufacturing the ink jet recording head.

2. Related Background Art

Generally the ink jet recording head includes an ink discharge port for discharging a micro ink droplet, an energy generation element for supplying energy to the ink droplet, and an ink flow path for supplying the ink. In the ink jet recording head, high-resolution and high-speed recording can be realized.

The method disclosed in U.S. Pat. No. 5,478,606 can be cited as an example of the method for manufacturing the ink jet recording head. Further, in order to optimize a three-dimensional shape of an ink flow path, for example, U.S. Published Application No. 2003/011655 proposes the method in which an ink flow path pattern is formed in two layers by using positive resists having photodegradation characteristics caused by light beams having two different wavelength ranges and the convex ink flow path is formed by causing the upper and lower patterns to be different from each other.

Because the shape of the ink flow path is determined by the pattern which becomes the ink flow path, in producing the ink jet recording head, it is important that the pattern of the ink flow path is formed with high accuracy. However, sometimes a mutually soluble layer is formed between the pattern and a coating layer when the coating layer is formed on the pattern, which results in the ink flow path having the shape different from the intended shape.

SUMMARY OF THE INVENTION

It is an object of the invention to provide the method for manufacturing the ink jet recording head which can form the intended ink flow path, particularly the convex ink flow path in the desired shape with no scum caused by the mutually soluble layer.

In order to achieve the object, a method for manufacturing an ink jet recording head of the invention includes (a) a process of forming a positive resist layer (I) made of a photodegradation positive resist (i) on a surface of a substrate having an energy generation element, (b) a process of removing a predetermined area of the positive resist layer (I) to form a micro structure which becomes at least an ink flow path, (c) a process of forming a coating resin layer on the surface of the substrate on which the micro structure has been formed, (d) a process of forming ink discharge ports in a portion where the coating resin layer covers the micro structure by photolithography, and (e) a process of removing the micro structure to form the ink flow path communicated with the ink discharge ports, wherein the photodegradation positive resist (i) includes a polymer having a glutarimide structure shown by the following chemical formula (1) in a molecule;

(1)

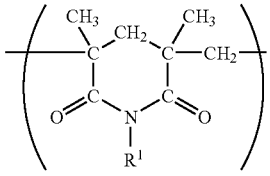

wherein $R^1$ designates a hydrogen atom or an alkyl group, an allyl group, or an aralkyl group which has the carbon number ranging from 1 to 20.

In accordance with the method for manufacturing an ink jet recording head of the invention, the ink flow path can be accurately formed.

It is preferable that a positive resist layer (II) made of a photodegradation positive resist (ii) on the surface of the substrate, the photodegradation positive resist (ii) being different from the photodegradation positive resist (i) in a photosensitive wavelength range, and a method for manufacturing an ink jet recording head of the invention further includes (f) a process of removing a predetermined area of the positive resist layer (II) by a photolithographic process including an exposure step and a development step and forming the micro structure which becomes at least the ink flow path in the positive resist layer (II) in advance of the process (c). In accordance with the method for manufacturing an ink jet recording head of the invention, the convex ink flow path can be accurately formed. At this point, it is preferable that the photodegradation positive resist (ii) mainly includes polymethyl isopropenyl ketone.

In the above-described ink jet recording head manufacturing method, it is preferable that the polymer having the glutarimide structure further includes a methacrylate ester unit shown by the following chemical formula (2) in the molecule;

(2)

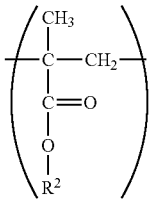

wherein $R^2$ designates the alkyl group having the carbon number ranging from 1 to 3.

Particularly, it is preferable that the polymer having the glutarimide structure is synthesized by a method in which methacrylate ester polymer shown by the following chemical formula (3) is partially glutarimidized by reaction with ammonia and/or primary amine;

(3)

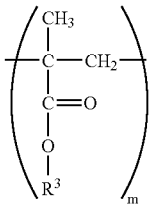

wherein $R^3$ designates the alkyl group having the carbon number from 1 to 3, and m is 11 or more.

At this point, it is preferable that 10 percent to 90 percent methacrylate ester unit included in the methacrylate ester polymer is glutarimidized in the polymer having the glutarimide structure. Further, it is preferable that the methacrylate ester polymer is the polymer having a methyl methacrylate unit.

It is preferable that alkaline aqueous solution, in particular, tetramethylammonium hydroxide solution and/or tetraethylammonium hydroxide solution is used as a developer in the development step in the process (b).

In the ink jet recording head manufactured by the above-described ink jet recording head manufacturing method, the intended ink flow path can be accurately formed.

BRIEF DESCRIPTION OF THE DRAWINGS

FIG. 1A shows a state in which a positive resist layer (I) is formed, FIG. 1B shows the state in which a micro structure to be an ink flow path pattern is formed in the positive resist layer (I), FIG. 1C shows the state in which a negative resist layer and an ink-repellent layer are formed, FIG. 1D shows the state in which ink discharge ports are formed, FIG. 1E shows the state in which a protection layer and an etching mask are formed, FIG. 1F shows the state in which an ink supply port is formed, and FIG. 1G shows a structure of the ink jet recording head in which the ink flow path is formed; FIG. 2A shows the state in which a positive resist layer (II) is formed, FIG. 2B shows the state in which the positive resist layer (I) is formed on the positive resist layer (II), FIG. 2C shows the state in which the micro structure to be the ink flow path pattern is formed in the positive resist layer (II) and the positive resist layer (I), FIG. 2D shows the state in which the negative resist layer and the ink-repellent layer are formed, FIG. 2E shows the state in which the ink discharge ports are formed, FIG. 2F shows the state in which the protection layer and the etching mask are formed, FIG. 2G shows the state in which the ink supply port is formed, and FIG. 2H shows the structure of the ink jet recording head in which the convex ink flow path is formed.

DETAILED DESCRIPTION OF THE PREFERRED EMBODIMENTS

Referring to the accompanying drawings, preferred embodiments of the invention will be described in detail below.

First Embodiment

FIGS. 1A to 1G schematically show the method for manufacturing the ink jet recording head according to a first embodiment of the invention.

Figure 1A:
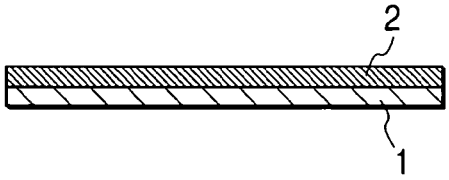
FIGS. 1A, 1B, 1C, 1D, 1E, 1F and 1G are schematic sectional views showing a change in a substrate in a time-series manner in a process of manufacturing an ink jet recording head according to an embodiment of the invention.

In the invention, a process (a) of forming a positive resist layer (I) made of a photodegradation positive resist (i) on the surface of the substrate having the energy generation element is first performed (FIG. 1A).

A substrate 1 made of glass, ceramic, metal, and the like is used as the substrate. The substrate 1 includes the energy generation element (not shown) for discharging the ink droplet. While an electrothermal energy generation element, a piezoelectric element, or the like can be used as the energy generation element, the energy generation element is not limited to the above-described elements. It is also possible to form the protection layer on the energy generation element for the purpose of release of impact in bubble foaming or reduction of damage from the ink.

Then, the photodegradation positive resist (i) is applied onto the surface of the substrate 1 to form the positive resist layer (I) 2. The applying method includes a spin coat method, a direct coat method, and a laminate transfer method. Generally, the resist such as polymethyl isopropenyl ketone (PMIPK) or polyvinyl ketone which has a photosensitive wavelength range near 290 nm or the resist having the photosensitive wavelength range near 250 nm like a polymer compound including a methacrylate ester unit such as polymethyl methacrylate can be used as the photodegradation positive resist (i), and one of the features of the invention is to use the photodegradation positive resist (i) containing a polymer having a glutarimide structure shown by the following chemical formula (1) in a molecule:

(1)

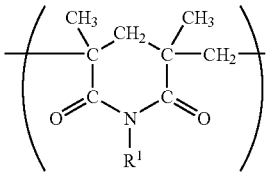

wherein $R^1$ designates a hydrogen atom or an alkyl group, an allyl group, or an aralkyl group which has the carbon number ranging from 1 to 20.

A methyl group, an ethyl group, a propyl group, a butyl group, and the like can be cited as the alkyl group which becomes $R^1$. A phenyl group, a naphthyl group, a tolyl group, and the like can be cited as the allyl group which becomes $R^1$. A benzyl group, a phenethyl group, a styryl group, and the like can be cited as the aralkyl group, which becomes $R^1$. It is possible that $R^1$ is made of either the single polymer or at least two types of polymers. From the viewpoint of development characteristics with alkaline aqueous solution, it is desirable that $R^1$ contains the hydrogen atom not lower than 20 mole percent. It is preferable that $R^1$ except for the hydrogen atom is the methyl group. The positive resist layer (I) 2 made of a photodegradation positive resist (i) including polymer having the glutarimide structure has high solvent resistance and is not affected by various solutions used in the manufacturing processes, so that the shape of the pattern can be maintained even after manufacturing. Further, the positive resist layer (I) 2 made of a photodegradation positive resist (i) never forms the mutually soluble layer between the positive resist layer (I) 2 and the later-mentioned negative resist layer. Therefore, the ink flow path having the intended shape can be formed after the manufacturing.

It is preferable that the polymer having the glutarimide structure further includes the methacrylate ester unit shown by the following chemical formula (2) in the molecule:

(2)

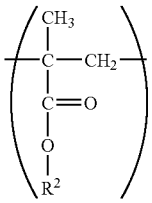

wherein $R^2$ designates the alkyl group having the carbon number ranging from 1 to 3.

The methyl group, the ethyl group, and the propyl group can be cited as the alkyl group which becomes $R^2$.

The polymer having the glutarimide structure, for example as described in Japanese Patent Publication No. H07-3579, can be synthesized by the method in which methacrylate ester polymer shown by the following chemical formula (3) is partially glutarimidized by reaction with ammonia and/or primary amine:

(3)

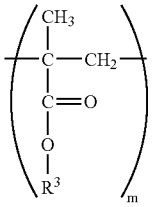

wherein $R^3$ designates the alkyl group having the carbon number from 1 to 3, and m is 11 or more.

The methyl group, the ethyl group, and the propyl group can be cited as the alkyl group which becomes $R^3$ of the methacrylate ester polymer. It is possible that $R^3$ is made of either the single polymer or at least two types of polymers. Particularly, from the viewpoint of the solvent resistance, it is preferable that the methacrylate ester polymer has a methyl methacrylate unit, in which $R^3$ becomes the methyl group, such as methyl methacrylate homopolymer or a copolymer having the methyl methacrylate unit. This is because $R^3$ in the ethyl group and the propyl group is higher than $R^3$ in the methyl group in solubility in the developer for the unreacted methacrylate ester unit which has not been glutarimidized.

Corresponding to the glutarimide structure shown by the chemical formula (1), a material having the structure of $R_1NH_2$ can be used as the ammonia and/or primary amine. When the polymer in which $R^1$ has at least two types is synthesized, it is possible to use a mixture of a plurality of types selected from the ammonia and primary amine.

For example, the reaction of the methacrylate ester polymer and the ammonia and/or primary amine can be performed under conditions that the methacrylate ester polymer is melted to add the ammonia and/or primary amine into the melted methacrylate ester polymer under pressure. At this point, it is also possible that a degree of the glutarimidization is controlled by changing the manufacturing conditions such as residence time, pressure, and temperature. In the invention, from the viewpoint of suppression of the mutually soluble layer at the interface between the positive resist layer (I) 2 and the negative resist layer and the resistance against the solvent used in the manufacturing processes, it is preferable that the degree of the glutarimidization ranges from 10 percent to 90 percent of the methacrylate ester unit included in the methacrylate ester polymer. It is more preferable that the degree of the glutarimidization ranges from 40 percent to 60 percent of the methacrylate ester unit. Further, from the viewpoint of applying characteristics and patterning performed by an exposure machine, in the positive resist, it is preferable that a weight-average molecular weight is not lower than 50000 and the photosensitive wavelength range ranges from 210 to 260 nm.

Figure 1B:
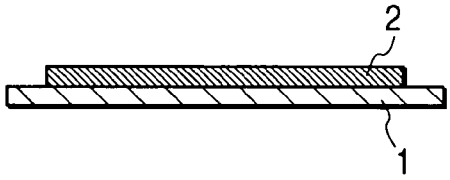

Then, a process (b) in which the predetermined area of the positive resist layer (I) is removed by a photolithographic process including an exposure step and a development step to form the micro structure which becomes at least the ink flow path in the positive resist layer (I) is performed in the invention (FIG. 1B).

A quartz mask in which the ink flow path is patterned is put on the positive resist layer (I) 2 which has been formed on the surface of the substrate 1 in the process (a), and the positive resist layer (I) 2 is irradiated with ionizing radiation through the quartz mask. The ionizing radiation includes the wavelength range near 250 nm which is the photosensitive wavelength range of the photodegradation positive resist (i) in the invention. This allows a decomposition reaction of the photodegradation positive resist (i) to be generated in the area irradiated with the ionizing radiation in the positive resist layer (I) 2 to selectively improve the solubility of the area in the developer. Therefore, the micro structure which becomes the ink flow path can be formed by developing the positive resist layer (I) 2.

It is optimum to use the developer which perfectly removes the exposed portion where the solubility is improved and does not solve the unexposed portion, and it is preferable to use the alkaline aqueous solution for the developer. It is possible to preferably use the aqueous solution of tetramethylammonium hydroxide (TMAH, i.e. Tama Chemicals Co., Ltd.) and tetraethylammonium hydroxide (TEAH), or the developer having composition disclosed in JP-B No. 3-10089. However, the invention is not limited to the above-described solution and developer. The solution including the following composition can be used as an example of the developers described in Japanese Patent Publication No. H03-10089.

diethylene glycol monobutyl ether: 60 volume percent
monoethanolamine: 5 volume percent
morpholine: 20 volume percent
ion-exchanged water: 15 volume percent Particularly, from the viewpoint of the patterning characteristics after the development, it is preferable to use the aqueous solution of tetramethylammonium hydroxide and/or tetraethylammonium hydroxide.

Figure 1C:
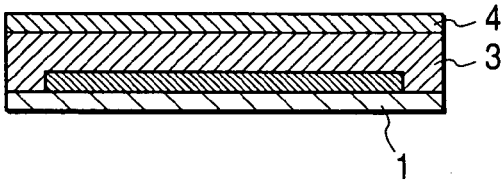

Then, a process (c) in which the negative resist layer made of the intermolecular crosslinkable negative resist is formed on the surface of the substrate on which the micro structure has been formed is performed in the invention (FIG. 1C).

While it is possible to use the intermolecular crosslinkable negative resist utilizing the reaction such as cationic polymerization and radical polymerization, the invention is not limited to the negative resist utilizing the reaction such as cationic polymerization and radical polymerization. Taking the negative resist utilizing the cationic polymerization reaction as an example, the cation generated from a photocationic initiator included in the negative resist causes the polymerization or the crosslink to progress among molecules of monomers which is included in the negative resist and can be cationic polymerized, which results in the curing.

Aromatic iodate, aromatic sulfonate, and the like, specifically SP-170 and SP-150 (trade name, available from Asahi Denka Co., Ltd.) can be cited as the photocationic initiator. While the monomer having an epoxy group, vinyl ether group, or an oxetane group is suitable to the monomer which can be cationic polymerized, the invention is not limited to the monomer having an epoxy group, vinyl ether group, or an oxetane group. Bisphenol A-type epoxy resins, novolac resins, ARONOXETANE OXT-211 (product of TOAGOSEI Co., Ltd.), cycloaliphatic epoxy resins such as CELLOXIDE 2021 (product of DAICEL CHEMICAL INDUSTRIES, LTD.), monoepoxide having a straight-chain alkyl group such as AOE (trade name, product of DAICEL CHEMICAL INDUSTRIES, LTD.) can be cited as examples of the preferable monomer. EHPE-3150 (trade name, product of DAICEL CHEMICAL INDUSTRIES, LTD.) which is of polyfunctional epoxy resins described in Japanese Patent No. 3143308 exhibits higher cationic polymerization characteristics when compared with the above-described resins, and EHPE-3150 also exhibits high crosslink density when cured. The cured material having higher strength can be obtained by EHPE-3150, so that it is particularly preferable to use EHPE-3150 as the monomer. While the above-described resins are preferably used as the intermolecular crosslinkable negative resist, the invention is not limited to those resins. A negative resist layer 3 is formed by applying the intermolecular crosslinkable negative resist onto the micro structure which becomes the ink flow path by the method such as the spin coat method, the direct coat method, and the laminate transfer method.

It is also possible to form an ink-repellent layer 4 on the negative resist layer 3 as needed. In this case, it is desirable that the resin forming the ink repellent layer 4 has intermolecular crosslinkable photosensitive characteristics like the negative resist. Further, it is also important the ink-repellent layer 4 is not mutually soluble with the negative resist. It is not always necessary that the resin forming the ink-repellent layer 4 includes the photopolymerization initiator, and it is possible to perform the curing by the crosslink with active species generated from the negative resist. The ink-repellent layer 4 is formed by the method such as the spin coat method, the direct coat method, and the laminate transfer method.

Figure 1D:
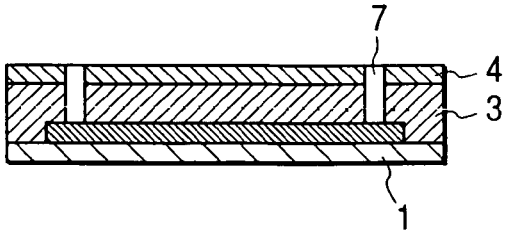

Then, a process (d) in which the ink discharge ports are formed in a predetermined portion of the negative resist layer is performed in the invention (FIG. 1D).

In the process (d), the intermolecular crosslinkable negative resist is cured by irradiating the area except for the portion which becomes the ink discharge ports with the light by the exposure machine (for example, Canon mask aligner MPA600FA (product of Canon Inc.)). When the ink-repellent layer 4 is formed on the negative resist layer 3, the resin of the ink-repellent layer 4 in the area except for the portion which becomes the ink discharge ports is simultaneously cured. Then, the ink discharge ports 7 are formed by the development. It is optimum to use the developer which does not solve the cured negative resist (and the resin of the ink-repellent layer) of the exposed portion, can perfectly remove the negative resist (and the resin of the ink-repellent layer) of the unexposed portion, and does not solve the photodegradation positive resist (i) arranged beneath the negative resist. Methyl isobutyl ketone (MIBK) or mixed solution of methyl isobutyl ketone and xylene is used as the developer. The reason why it is important not to solve the photodegradation positive resist (i) is that, when the plurality of recording heads is arranged on one substrate and the recording heads are used through a cutting process, it is desirable to solve and remove the micro structure forming the ink flow path after the cutting process for the purpose of countermeasures against contamination during the cutting process.

Figure 1E:
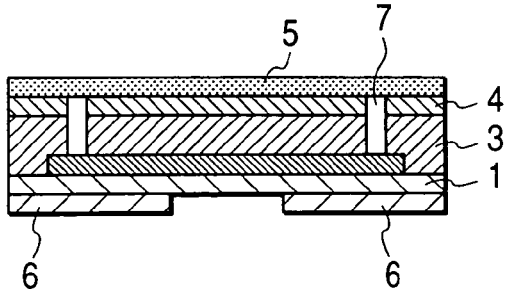
Figure 1F:
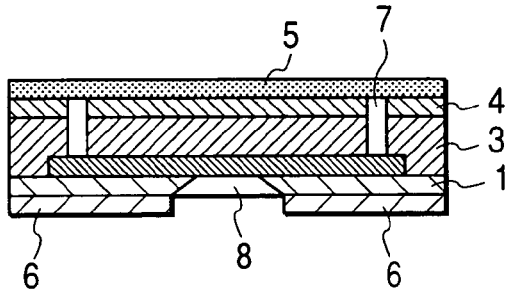

An ink supply port 8 piercing through the substrate 1 is generally formed (FIGS. 1E and 1F). While anisotropic etching or dry etching is usually used as the method for forming the ink supply port 8, the invention is not limited to the anisotropic etching or the dry etching. The anisotropic etching method which uses a Si substrate having a certain crystal orientation will be described as an example. The surface of the substrate is covered with a protection layer 5 made of the resin (for example, OBC (product of TOKYO OHKA KOGYO CO., LTD.)) having etching solution resistance, and a backside of the substrate 1 is covered with an etching mask 6 (For example, polyether amide resin (HIMAL (product of Hitachi Chemical Co., Ltd.,)) while only a slit portion having a size of the ink supply port is left (FIG. 1E). Only the portion exposed from the slit portion of the substrate can be solved by dipping the substrate into the alkaline etching solution such as potassium hydrate aqueous solution, sodium hydrate aqueous solution, and tetramethylammonium hydroxide (TMAH) aqueous solution, which allows the ink supply port 8 to be formed (FIG. 1F).

Then, the protection layer 5 covering the ink discharge ports 7 is removed, and the etching mask 6 is removed if necessary.

Figure 1G:
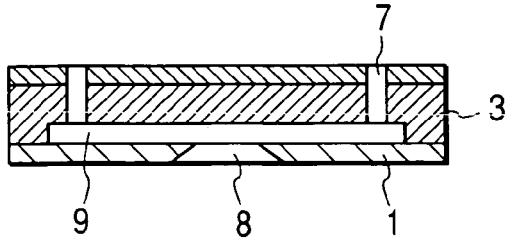

Then, a process (e) in which the micro structure is removed to form the ink flow path communicated with the ink discharge ports is formed in the invention (FIG. 1G).

In the process (e), the solubility in the developer is improved by irradiating the photodegradation positive resist (i) forming the micro structure which becomes the ink flow path with the ionizing radiation to generate the decomposition reaction of the positive resist (i). The same ionizing radiation for the process (b) can be used in the process (e). However, because it is the purpose of the process (e) to remove the micro structure to form the ink flow path, the overall surface of the photodegradation positive resist (i) can be irradiated with the ionizing radiation with no mask. Then, the photodegradation positive resist (i) forming the micro structure is perfectly removed using the same developer for the process (e). However, in the process (e), it is not necessary to consider the patterning characteristics, so that methyl lactate can be also used as the solvent which does not affect the negative resist. As a result, the ink jet recording head in which the ink flow path 9 is formed can be obtained.

Second Embodiment

The method for manufacturing the ink jet recording head having a convex ink flow path will be described in detail as a second embodiment of the invention.

FIGS. 2A to 2H schematically show the method for manufacturing the ink jet recording head according to a second embodiment of the invention.

Figure 2A:
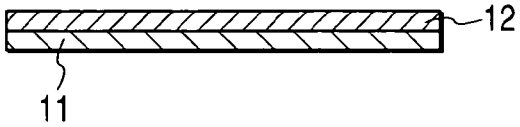
FIGS. 2A, 2B, 2C, 2D, 2E, 2F, 2G and 2H are schematic sectional views showing the change in the substrate in the time-series manner in the process of manufacturing the ink jet recording head according to an embodiment of the invention.

A positive resist layer (II) 12 made of a photodegradation positive resist (ii) which is different from the photodegradation positive resist (i) in the photosensitive wavelength range is formed on the surface of a substrate 11 (FIG. 2A).

As described above, since the photosensitive wavelength range of the photodegradation positive resist (i) including the glutarimide structure is around 250 nm, the resist made of polymethyl isopropenyl ketone (PMIPK), polyvinyl ketone, or the like which does not exhibit the photodegradation characteristics for the light near 250 nm but exhibits the photodegradation characteristics for the light near 290 nm can be used as the photodegradation positive resist (ii). Particularly, from the viewpoint of wavelength separation from the photodegradation positive resist (i) during the exposure, it is preferable that the photodegradation positive resist (ii) mainly includes polymethyl isopropenyl ketone. The words of "mainly includes" mean that polymethyl isopropenyl ketone of not lower than 90 mass percent is included in the photodegradation positive resist (ii). The photodegradation positive resist (ii) is applied onto the surface of the substrate 11 to form the positive resist layer (II) 12. The applying method includes the spin coat method, the direct coat method, and the laminate transfer method.

Figure 2B:
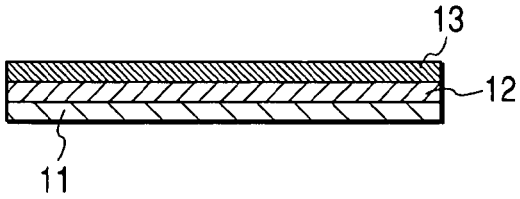

Similarly to the process (a) in the first embodiment, a double-layer structure is maid by forming a positive resist layer (I) 13, which is made of the photodegradation positive resist (i) including the polymer having the glutarimide structure, on the surface of the substrate on which the positive resist layer (II) 12 has been formed (FIG. 2B).

Figure 2C:
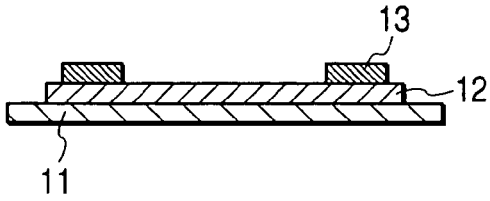

Similarly to the process (b) in the first embodiment, the predetermined area of the positive resist layer (I) 13 is removed by the photolithographic process including the exposure step and the development step, and the micro structure which becomes at least the ink flow path is formed in the positive resist layer (I) 13. Then, a process (f) in which the predetermined area of the positive resist layer (II) 12 is removed by the photolithographic process including the exposure step and the development step and the micro structure which becomes at least the ink flow path is formed in the positive resist layer (II) 12 is performed. The two-layer micro structure which becomes the convex ink flow path can be formed in the above-described manner (FIG. 2C).

The process (f) can be performed by the same technique as the process (b) in the first embodiment. However, in order to form the two-layer micro structure whose layers have the shapes different from each other, it is necessary to change the wavelengths of the ionizing radiation used in the process (b) and the process (f). Namely, the ionizing radiation used in the process (b) includes the wavelength range near 250 nm which is of the photosensitive wavelength range of the photodegradation positive resist (i), but does not include the wavelength range near 290 nm which is of the photosensitive wavelength range of the photodegradation positive resist (ii). The ionizing radiation used in the process (f) does not include the wavelength range near 250 nm which is of the photosensitive wavelength range of the photodegradation positive resist (i), but includes the wavelength range near 290 nm which is of the photosensitive wavelength range of the photodegradation positive resist (ii). Further, the two-layer micro structure whose layers have the shapes different from each other can be formed by changing the shapes of the masks used in the process (b) and the process (f). Although the mode in which the process (f) is performed after the process (b) was described in this case, the process (f) may be performed in advance of the process (c) of forming the negative resist layer, e.g. it is also possible that the two layers are irradiated with the ionizing radiation and then the development of the two layers is performed.

In the invention, when polymethyl isopropyl ketone is used as the photodegradation positive resist (ii), the removal characteristics are improved, compared with the case in which methacrylate ester is used. Therefore, the removal characteristics of the lower layer (positive resist layer (II) 12) which occupies the large portion in the micro structure are improved to reduce the removal time as a whole, so that productivity can be improved in manufacturing the ink jet recording head. It is known that polymethyl isopropenyl ketone forming the lower layer is modified by applying the high temperature. However, it is not necessary to apply the high temperature to the photodegradation positive resist (i) including the polymer having the glutarimide structure for forming the upper layer (positive resist layer (I) 13) when the upper layer is formed, so that the convex ink flow path can be accurately formed without modifying polymethyl isopropenyl ketone. Form this point of view, it is preferable that polymethyl isopropenyl ketone is used as the photodegradation positive resist (ii) and the formed positive resist layer (II) 12 and positive resist layer (I) 13 are combined to form the two-layer microstructure.

Figure 2D:
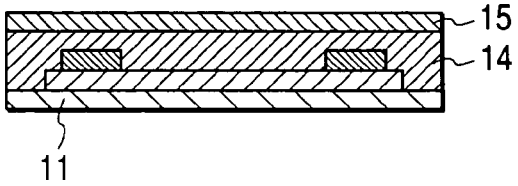

After forming the micro structure by the above-described processes, similarly to the process (c) in the first embodiment, a negative resist layer 14 made of the intermolecular crosslinkable negative resist is formed on the surface of the substrate on which the micro structure has been formed (FIG. 2D). An ink-repellent layer 15 is formed as needed.

Figure 2E:
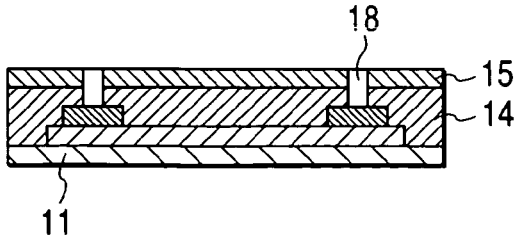
Figure 2F:
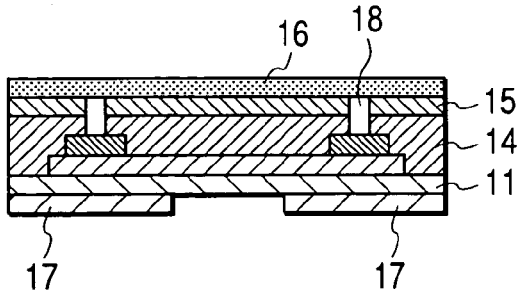

Similarly to the process (d) in the first embodiment, the ink discharge ports 18 are formed in the predetermined portion of the negative resist layer 14 (and the ink-repellent layer 15) is performed (FIG. 2E). In this case, it is optimum to use the developer which does not solve the cured negative resist (and the resin of the ink-repellent layer) of the exposed portion, can perfectly remove the negative resist (and the resin of the ink-described repellent layer) of the unexposed portion, and does not solve the photodegradation positive resist (i) and the photodegradation positive resist (ii) which are arranged beneath the negative resist. Methyl isobutyl ketone (MIBK) or the mixed solution of methyl isobutyl ketone and xylene is used as the developer.

Figure 2G:
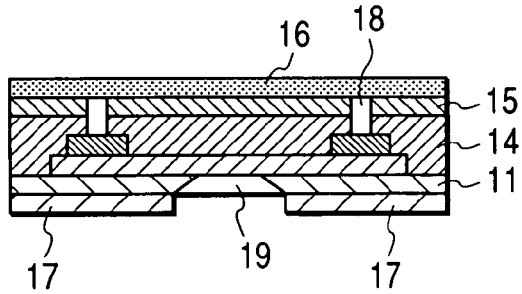

Further, similarly to the process (d) in the first embodiment, the surface of the substrate is covered with a protection layer 16, the backside of the substrate 11 is covered with an etching mask 17 while only the slit portion having the size of the ink supply port is left, and the substrate is dipped into the etching solution. As a result, an ink supply port 19 can be formed (FIG. 2G).

Figure 2H:
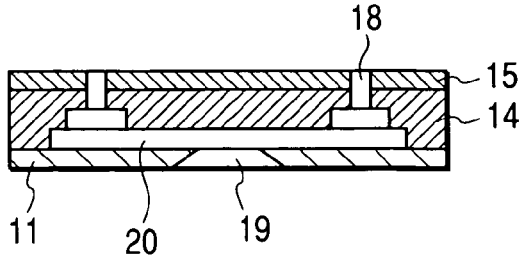

Similarly to the process (e) in the first embodiment, a convex ink flow path 20 can be formed by removing the micro structure (FIG. 2H). In the process (e), it is simple and preferable that the decomposition reactions of both the photodegradation positive resist (i) and the photodegradation positive resist (ii), which form the micro structure which becomes the ink flow path, are simultaneously generated to improve the solubility in the developer, such that the photodegradation positive resist (i) and the photodegradation positive resist (ii) are irradiated with the ionizing radiation including the wavelength ranges near 250 nm and 290 nm which are the photosensitive wavelength ranges of the both resists.

As described above, in accordance with the method for manufacturing an ink jet recording head of the invention, the ink jet recording head in which the intended ink flow path is accurately formed can be manufactured. In accordance with the ink jet recording head, the printing can be stably performed and high-quality print can be obtained

EXAMPLE 1

In Example 1, the ink jet recording head was manufactured by the method for manufacturing an ink jet recording head shown by FIGS. 1A to 1G.

First the silicon substrate 1 was prepared. The energy generation element and a logic circuit for discharging the ink droplet were formed in the substrate 1.

Then, the positive resist layer (I) 2 made of the photodegradation positive resist (i) was formed in the laminar shape on the substrate 1. The photodegradation positive resist (i) used in Example 1 was obtained as follows:

The photodegradation positive resist (i) (weight-average molecular weight: 85000) included the polymer in which 30 percent methyl methacrylate unit was glutarimidized by the reaction of polymethyl methacrylate and the mixed solution of 20 mass percent ammonia and 80 mass percent methyl amine.

Specifically, the resist solution in which the photodegradation positive resist (i) of about 19 mass percent in terms of solid content concentration was solved in cyclopentanone was applied to the substrate by the spin coat method under the conditions of 1200 rpm for 30 seconds. Then, pre-bake was performed on a hot plate at 90° C. for 3 minutes to form the positive resist layer (I) 2 having the thickness of 10 μm.

Then, the patterning was performed to the micro structure which becomes the ink flow path. The positive resist layer (I) 2 formed in the laminar shape was irradiated with UV light by using Deep-UV exposure machine UX-3000 (product of USHIO INC.) so that the integrated amount of exposure became 80000 mJ/cm$^2$. At this point, the positive resist layer (I) 2 was irradiated with the UV light through the mask in which the ink flow path was patterned. Then, the development was performed with TMAH (Tama Chemicals Co., Ltd.) and rinse treatment was performed with water. As a result, the exposed portion was perfectly removed to form the micro structure.

Then, the micro structure was covered with the negative resist layer 3 made of the intermolecular crosslinkable negative resist. The resist solution having the following composition was used as the intermolecular crosslinkable negative resist:

Epoxy resin EHPE-3150 (product of DAICEL CHEMICAL INDUSTRIES, LTD.): 100 mass parts Additive HFAB (product of Central Glass Co., Ltd.): 20 mass parts Silane coupling agent A-187 (product of Nippon Unicar Co., Ltd.): 5 mass parts Photocationic polymerization catalyst SP170 (product of Asahi Denka Co., Ltd.): 2 mass parts Solvent (1) MIBK (product of TOKYO OHKA KOGYO CO., LTD.): 40 mass parts Solvent (2) diglyme: 40 mass parts The resist solution was applied by the spin coat method so as to perfectly cover the micro structure, and the pre-bake was performed on the hot plate at 90° C. for 3 minutes to form the negative resist layer 3 having the thickness of 20 μm. The ink-repellent layer 4 made of resin having the photosensitivity was formed on the negative resist layer 3 by the laminate transfer method. The composition of the resin was as follows:

Epoxy resin EHPE-3150 (product of DAICEL CHEMICAL INDUSTRIES, LTD.): 35 mass parts Additive 2,2-bis(4-glycidyl oxyphenyl) hexafluoropropane: 25 mass parts Additive 1,4-bis(2-hydroxy-hexanfluoroisopropyl) benzene: 25 mass parts Additive 3- (2-perfluorohexyl)ethoxy -1,2-epoxypropane: 16 mass parts Silane coupling agent A-187 (product of Nippon Unicar Co., Ltd.): 4 mass parts Photocationic polymerization catalyst SP170 (product of Asahi Denka Co., Ltd.): 1.5 mass parts Additive diethylene glycol monomethyl ether: 200 mass parts The ink-repellent layer 4 was irradiated with the amount of exposure of 3000 mJ/cm$^2$ by the exposure machine (mask aligner MPA600FA, product of Canon Inc.). In this case, the ink-repellent layer 4 was irradiated through the mask in which the ink discharge ports were patterned.

The ink discharge ports 7 were formed by developing the negative resist layer in which the pattern exposure treatment had been performed. The mixed solution of methyl isobutyl ketone (MIBK)/xylene=⅔ was used as the developer, and the unexposed portion was perfectly removed by performing the rinse treatment with xylene. As a result the ink discharge ports 7 were formed.

Then, the ink supply port 8 was formed in the backside of the substrate 1 by the etching treatment. OBC (product of TOKYO OHKA KOGYO CO., LTD.) as the protection layer 5 was applied on the overall surface of the ink-repellent layer 4. The slit-shaped etching mask 6 was formed on the backside of the substrate by using polyether amide resin (HIMAL (product of Hitachi Chemical Co., Ltd.), and the anisotropic etching relative to the substrate was performed by dipping the substrate into the TMAH solution at 80° C. to form the ink supply port 8. It is also possible the etching mask 6 was formed from the beginning in preparing the substrate.

Then, after OBC which was of the protection layer 5 was removed with xylene, the substrate was exposed from above the ink-repellent layer 4 with the Deep-UV exposure machine UX-3000 (product of USHIO INC.) to cause the photodegradation positive resist (i) forming the micro structure to be solubilized. Then, the photodegradation positive resist (i) was perfectly removed by dipping the substrate into an ultrasonic tank with methyl lactate to form the ink jet recording head shown in FIG. 1G.

When the ink jet recording head formed in Example 1 was mounted on the printer to perform the discharge and recording evaluation, the printing could be stably performed and the obtained print was high quality.

EXAMPLE 2

The ink jet recording head was produced by the same technique as Example 1 except that the photodegradation positive resist (i) used in Example 2 was obtained as follows:

The photodegradation positive resist (i) (weight-average molecular weight: 85000) included the polymer in which 60 percent methyl methacrylate unit was glutarimidized by the reaction of polymethyl methacrylate and the mixed solution of 20 mass percent ammonia and 80 mass percent methyl amine.

When the ink jet recording head formed in Example 2 was mounted on the printer to perform the discharge and recording evaluation, the printing could be stably performed and the obtained print was high quality.

EXAMPLE 3

The ink jet recording head was produced by the same technique as Example 1 except that the photodegradation positive resist (i) used in Example 3 was obtained as follows:

The photodegradation positive resist (i) (weight-average molecular weight: 50000) included the polymer in which 30 percent methyl methacrylate unit was glutarimidized by the reaction of polymethyl methacrylate and the mixed solution of 20 mass percent ammonia and 80 mass percent methyl amine.

When the ink jet recording head formed in Example 3 was mounted on the printer to perform the discharge and recording evaluation, the printing could be stably performed and the obtained print was high quality.

EXAMPLE 4

In Example 4, the ink jet recording head having the convex ink flow path was manufactured by the method for manufacturing an ink jet recording head shown by FIGS. 2A to 2H.

First, the silicon substrate 11 was prepared. The energy generation element and the logic circuit for discharging the ink droplet were formed in the substrate 11.

Then, the positive resist layer (II) 12 made of the photodegradation positive resist (ii) was formed on the substrate 11. Polymethyl isopropyl ketone (ODUR-1010, product of TOKYO OHKA KOGYO CO., LTD.) was used as the photodegradation positive resist (ii), ODUR-1010 was applied onto the substrate 11 by the spin coat method, and the pre-bake was performed on the hot plate at 120° C. for 20 minutes to form the positive resist layer (II) 12 having the thickness of 10 μm.

Then, the positive resist layer (I) 13 made of the photodegradation positive resist (i) was formed. The photodegradation positive resist (i) used in Example 4 was obtained as follows:

The photodegradation positive resist (i) (weight-average molecular weight: 85000) included the polymer in which 30 percent methyl methacrylate unit was glutarimidized by the reaction of polymethyl methacrylate and the mixed solution of 20 mass percent ammonia and 80 mass percent methyl amine.

Specifically, the resist solution in which the photodegradation positive resist (i) of about 19 mass percent in terms of solid content concentration was solved in cyclopentanone was applied to the substrate by the spin coat method under the conditions of 1200 rpm for 30 seconds. Then, pre-bake was performed on a hot plate at 90° C. for 3 minutes to form the positive resist layer (I) 13 having the thickness of 8 μm.

In order to perform the patterning of the micro structure, at first the patterning was performed to the positive resist layer (I) 13 which is of the upper layer. The positive resist layer (I) 13 formed in the laminar shape was irradiated with the UV light by using the Deep-UV exposure machine UX-3000 (product of USHIO INC.) so that the integrated amount of exposure became 80000 mJ/cm$^2$. At this point, the positive resist layer (I) 13 was irradiated with the UV light having the wavelength range not more than 260 nm by an optical filter through the mask in which the ink flow path was patterned. Then, the development was performed by TMAH (Tama Chemicals Co., Ltd.) and rinse treatment was performed with water. As a result, the exposed portion in the positive resist layer (I) 13 of the upper layer was perfectly removed.

Then, the patterning was performed to the positive resist layer (II) 12 which is of the lower layer. The positive resist layer (II) 12 was irradiated with the UV light by using the Deep-UV exposure machine UX-3000 (product of USHIO INC.) again. At this point, the positive resist layer (II) 12 was irradiated with the UV light having the wavelength range not lower than 260 nm by an optical filter through the mask in which the ink flow path was patterned. The exposed portion in the positive resist layer (II) 12 of the lower layer was perfectly removed to form the convex micro structure by using the mixed solution of methyl isobutyl ketone (MIBK)/xylene=⅔ to perform the rinse treatment with xylene.

Then, the micro structure was covered with the negative resist layer 14 made of the intermolecular crosslinkable negative resist. The resist solution having the following composition was used as the intermolecular crosslinkable negative resist:

Epoxy resin EHPE-3150 (product of DAICEL CHEMICAL INDUSTRIES, LTD.): 100 mass parts Additive HFAB (product of Central Glass Co., Ltd.): 20 mass parts Silane coupling agent A-187 (product of Nippon Unicar Co., Ltd.): 5 mass parts Photocationic polymerization catalyst SP170 (product of Asahi Denka Co., Ltd.): 2 mass parts Solvent (1) MIBK (product of TOKYO OHKA KOGYO CO., LTD.): 40 mass parts Solvent (2) diglyme: 40 mass parts The resist solution was applied by the spin coat method so as to perfectly cover the micro structure, and the pre-bake was performed on the hot plate at 90° C. for 3 minutes to form the negative resist layer 14 having the thickness of 20 μm.

The ink-repellent layer 15 was formed on the negative resist layer 14. The composition of the ink-repellent layer 15 was as follows:

EHPE-3158 (product of DAICEL CHEMICAL INDUSTRIES, LTD.): 100 mass parts 2,2-bis(4-glycidyl oxyphenyl) hexafluoropropane: 25 mass parts 1,4-bis(2-hydroxy-hexanfluoroisopropyl) benzene: 25 mass parts 3-(2-perfluorohexyl)ethoxy -1,2-epoxypropane: 16 mass parts A-187 (product of Nippon Unicar Co., Ltd.): 4 mass parts SP170 (product of Asahi Denka Co., Ltd.): 2 mass parts Diethylene glycol monomethyl ether: 100 mass parts The ink-repellent layer 15 was applied onto the negative resist layer 14 by the spin coat method. Thereafter, the pre-bake was performed on the hot plate at 80° C. for 3 minutes to form ink-repellent layer 15.

The ink-repellent layer 15 was irradiated with the amount of exposure of 3000 mJ/cm$^2$ by the exposure machine (mask aligner MPA600FA, product of Canon Inc.). In this case, the ink-repellent layer 15 was irradiated through the mask in which the ink discharge ports were patterned.

The ink discharge ports 18 were formed by developing the negative resist layer in which the pattern exposure treatment had been performed. The mixed solution of methyl isobutyl ketone (MIBK)/xylene=⅔ was used as the developer, and the unexposed portion was perfectly removed by performing the rinse treatment with xylene. As a result, the ink discharge ports 18 were formed.

Then, the ink supply port 19 was formed in the backside of the substrate 11 by the etching treatment. OBC (product of TOKYO OHKA KOGYO CO., LTD.) as the protection layer 16 was applied on the overall surface of the ink-repellent layer 15. The slit-shaped etching mask 17 was formed on the backside of the substrate 11 by using polyether amide resin (HIMAL (product of Hitachi Chemical Co., Ltd.), and the anisotropic etching relative to the silicon substrate was performed by dipping the substrate into the TMAH solution at 80° C. to form the ink supply port 19.

Then, after OBC which was of the protection layer 16 was removed with xylene, the substrate was exposed from above the ink-repellent layer 15 with the Deep-UV exposure machine UX-3000 (product of USHIO INC.) to cause the photodegradation positive resist (i) and the photodegradation positive resist (ii) to be solubilized. Then, the photodegradation positive resist (i) and the photodegradation positive resist (ii) which formed the micro structure were perfectly removed by dipping the substrate into the ultrasonic tank with methyl lactate to form the ink jet recording head having the convex ink flow path as shown in FIG. 1G.

When the ink jet recording head formed in Example 4 was mounted on the printer to perform the discharge and recording evaluation, the printing could be stably performed and the obtained print was high quality.

EXAMPLE 5

The ink jet recording head was produced by the same technique as Example 4 except that the photodegradation positive resist (i) used in Example 4 was obtained as follows:

The photodegradation positive resist (i) (weight-average molecular weight: 85000) included the polymer in which 60 percent methyl methacrylate unit was glutarimidized by the reaction of polymethyl methacrylate and the mixed solution of 20 mass percent ammonia and 80 mass percent methyl amine.

The positive resist layer (I) was formed so as to have the thickness of 10 μm.

When the ink jet recording head formed in Example 5 was mounted on the printer to perform the discharge and recording evaluation, the printing could be stably performed and the obtained print was high quality.

EXAMPLE 6

The ink jet recording head was produced by the same technique as Example 4 except that the photodegradation positive resist (i) used in Example 6 was obtained as follows:

The photodegradation positive resist (i) (weight-average molecular weight: 50000) included the polymer in which 30 percent methyl methacrylate unit was glutarimidized by the reaction of polymethyl methacrylate and the mixed solution of 20 mass percent ammonia and 80 mass percent methyl amine.

The positive resist layer (I) was formed so as to have the thickness of 10 μm.

When the ink jet recording head formed in Example 6 was mounted on the printer to perform the discharge and recording evaluation, the printing could be stably performed and the obtained print was high quality.

This application claims priority from Japanese Patent Application No. 2003-306419 filed Aug. 29, 2003, which is hereby incorporated by reference herein.

What is claimed is:

1. A method for manufacturing an ink jet recording head compising:

(a) a process of forming a positive resist layer (I) made of a photodegradation positive resist (i) on a surface of a substrate having an energy generation element;

(b) a process of removing a predetermined area of the positive resist layer (I) by photolithography to form a micro structure which becomes at least an ink flow path;

(c) a process of forming a coating resin layer on the surface of the substrate on which the micro structure has been formed;

(d) a process of forming ink discharge ports in a portion where the coating resin layer covers the micro structure by photolithography; and (e) a process of removing the micro structure to form the ink flow path communicated with the ink discharge ports, wherein the photodegradation positive resist (i) includes a polymer having a glutarimide structure shown by the following chemical formula (1) in a molecule;

(1)

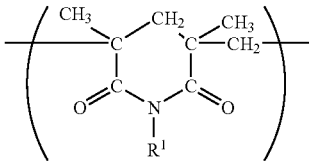

wherein $R^1$ designates a hydrogen atom or an alkyl group, an allyl group, or an aralkyl group which has the carbon number ranging from 1 to 20.

2. A method for manufacturing an ink jet recording head according to claim 1, wherein a positive resist layer (II) made of a photodegradation positive resist (ii) on the surface of the substrate, the photodegradation positive resist (ii) being different from the photodegradation positive resist (i) in a photosensitive wavelength range, further comprising (f) a process of removing a predetermined area of the positive resist layer (II) by a photolithographic process including an exposure step and a development step and forming the micro structure which becomes at least the ink flow path in the positive resist layer (II) in advance of the process (c).

3. A method for manufacturing an ink jet recording head according to claim 2, wherein the photodegradation positive resist (ii) mainly includes polymethyl isopropenyl ketone.

4. A method for manufacturing an ink jet recording head according to claim 1, the polymer having the glutarimide structure further includes a methacrylate ester unit shown by the following chemical formula (2) in the molecule;

(2)

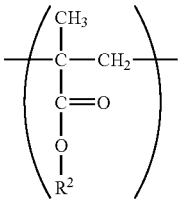

wherein $R^2$ designates the alkyl group having the carbon number ranging from 1 to 3.

5. A method for manufacturing an ink jet recording head according to claim 4, wherein the polymer having the glutarimide structure is synthesized by a method in which methacrylate ester polymer shown by the following chemical formula (3) is partially glutarimidized by reaction with ammonia and/or primary amine;

(3)

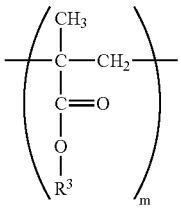

wherein $R^3$ designates the alkyl group having the carbon number from 1 to 3, and m is 11 or more.

6. A method for manufacturing an ink jet recording head according to claim 5, wherein 10 percent to 90 percent methacrylate ester unit included in the methacrylate ester polymer is glutarimidized in the polymer having the glutarimide structure.

7. A method for manufacturing an ink jet recording head according to claim 5, wherein the methacrylate ester polymer is the polymer having a methyl methacrylate unit.

* * * * *

UNITED STATES PATENT AND TRADEMARK OFFICE

CERTIFICATE OF CORRECTION

PATENT NO. : 7,175,973 B2
APPLICATION NO. : 10/914218
DATED : February 13, 2007
INVENTOR(S) : Okano et al.

It is certified that error appears in the above-identified patent and that said Letters Patent is hereby corrected as shown below:

COLUMN 5:
Line 52, "$R_1NH_2$" should read -- $R^1NH_2$ --.

COLUMN 8:
Line 19, "IE)." should read -- IE)). --.

COLUMN 9:
Line 14, "is maid" should read -- is made --.

COLUMN 10:
Line 57, "obtained" should read -- obtained. --.

COLUMN 11:
Line 58, "hexanfluoroisopropyl)" should read -- hexafluoroisopropyl) --.

COLUMN 12:
Line 19, "Ltd.)," should read -- Ltd.)), --.

COLUMN 14:
Line 23, "hexanfluoroisopropyl)" should read -- hexafluoroisopropyl) --; and
Line 53, "Ltd.)," should read -- Ltd.)), --.

COLUMN 15:
Line 47, "compising:" should read -- comprising: --.

Signed and Sealed this

Fourth Day of March, 2008

JON W. DUDAS
*Director of the United States Patent and Trademark Office*